US010351389B2

(12) United States Patent
Kato

(10) Patent No.: US 10,351,389 B2
(45) Date of Patent: Jul. 16, 2019

(54) ELEVATOR

(71) Applicant: MITSUBISHI ELECTRIC CORPORATION, Chiyoda-ku (JP)

(72) Inventor: Kunio Kato, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 263 days.

(21) Appl. No.: 15/533,542

(22) PCT Filed: Jul. 15, 2015

(86) PCT No.: PCT/JP2015/070269
§ 371 (c)(1),
(2) Date: Jun. 6, 2017

(87) PCT Pub. No.: WO2016/135999
PCT Pub. Date: Sep. 1, 2016

(65) Prior Publication Data

US 2017/0349409 A1 Dec. 7, 2017

(30) Foreign Application Priority Data

Feb. 24, 2015 (JP) ..... PCT/JP2015/055238

(51) Int. Cl.
*B66B 7/06* (2006.01)
*B66B 9/00* (2006.01)
*B66B 11/02* (2006.01)

(52) U.S. Cl.
CPC ..... *B66B 7/06* (2013.01); *B66B 7/066* (2013.01); *B66B 7/068* (2013.01); *B66B 9/00* (2013.01); *B66B 11/0206* (2013.01)

(58) Field of Classification Search
CPC .. B66B 7/06; B66B 7/066; B66B 9/00; B66B 11/0206
See application file for complete search history.

(56) References Cited

U.S. PATENT DOCUMENTS 2,537,075 A * 1/1951 Margles ..... B66B 7/068 187/264
3,882,968 A * 5/1975 Suozzo ..... B66B 7/068 187/264

(Continued)

FOREIGN PATENT DOCUMENTS

JP 61-11677 U 1/1986
JP 5-26972 U 4/1993

(Continued)

OTHER PUBLICATIONS

International Search Report dated Oct. 20, 2015, in PCT/JP2015/070269, filed Jul. 15, 2015.

*Primary Examiner* — Michael A Riegelman
(74) *Attorney, Agent, or Firm* — XSensus LLP

(57) ABSTRACT

This invention is concerning a car suspending pulley device including a pair of beams provided parallel to each other on a lower portion of a car and a car suspending pulley arranged between the pair of beams and supported by the pair of beams. A weight suspending pulley is provided on a counterweight. The car and the counterweight are suspended from a main rope wrapped around the car suspending pulley and the weight suspending pulley. A compensating member is suspended between the beams and the counterweight. The compensating member includes a funicular body having a first end portion connected to only one of the pair of beams and a second end portion connected to the counterweight. The first end portion of the funicular body is located in a region of the one beam when viewed in a vertical direction.

4 Claims, 6 Drawing Sheets

(56) References Cited

U.S. PATENT DOCUMENTS

| | | | | |
|---|---|---|---|---|
| 4,230,205 | A * | 10/1980 | Darwent | B66B 7/068 187/265 |
| 7,117,978 | B2 * | 10/2006 | Kaczmarek | B66B 7/068 187/276 |
| 7,610,994 | B2 * | 11/2009 | Green | B66B 7/068 187/251 |
| 2008/0164103 | A1 * | 7/2008 | Fanion | B66B 11/0206 187/266 |
| 2014/0353091 | A1 * | 12/2014 | Fauconnet | B66B 7/064 187/413 |
| 2016/0083223 | A1 * | 3/2016 | Altenburger | B66B 7/068 187/251 |
| 2016/0159612 | A1 * | 6/2016 | Watanabe | B66B 7/068 187/413 |
| 2016/0159615 | A1 * | 6/2016 | Maruyama | B66B 11/0206 187/266 |
| 2016/0207738 | A1 * | 7/2016 | Altenburger | B66B 7/064 |
| 2017/0349409 | A1 * | 12/2017 | Kato | B66B 7/06 |

FOREIGN PATENT DOCUMENTS

| | | | |
|---|---|---|---|
| JP | 2001-48444 | A | 2/2001 |
| JP | 2012-153467 | A | 8/2012 |
| SG | 182903 | A1 | 8/2012 |

* cited by examiner

ELEVATOR

TECHNICAL FIELD

The present invention relates to an elevator in which compensating members are suspended between a car and a counterweight.

BACKGROUND ART

Conventionally, elevators are known in which balance chains are suspended between a car and a counterweight in order to compensate for a discrepancy in balance between a car side and a counterweight side. In a conventional elevator, one end portion of a balance chain is connected to a lower portion of a car, and the other end portion of the balance chain is connected to a lower portion of a counterweight (see PTL 1).

CITATION LIST

Patent Literature

[PTL 1] Japanese Utility Model Application Publication No. S61-11677

SUMMARY OF INVENTION

Technical Problem

In conventional elevators, the load of a balance chain applied to a lower portion of a car increases when the car is located at an uppermost floor, thus it is necessary to strengthen the lower portion of the car, which results in an increase in cost.

The present invention has been made to solve the above-mentioned problem and an object thereof is to obtain an elevator that enables cost to be reduced.

Solution to Problem

An elevator according to the present invention is an elevator provided with a car, a counterweight, a car suspending pulley device including a pair of beams provided parallel to each other on a lower portion of the car and a car suspending pulley arranged between the pair of beams and supported by the pair of beams, a weight suspending pulley provided on the counterweight, a main rope wrapped around the car suspending pulley and the weight suspending pulley and suspending the car and the counterweight, and a compensating member including a funicular body having a first end portion connected to only one of the pair of beams and a second end portion connected to the counterweight, and suspended between the one beam and the counterweight, wherein the first end portion is located in a region of the one beam when viewed in a vertical direction.

Advantageous Effects of Invention

With the elevator according to the present invention, a compensating member is connected respectively to a beam of a car suspending pulley device and a counterweight, hence, a downward load of the compensating member can be applied to the beam, to which an upward load of a main rope from which the car is suspended is applied, in a direction that cancels out the upward load, such that the strength of the beam does not have to be increased. Further, as a first end portion of a funicular body is connected to only one beam, it is possible to eliminate a part that is fixed so as to span a pair of beams, whereby a number of parts can be reduced and a configuration simplified. As a result, cost can be reduced. Further, the first end portion of the funicular body is located in a region of the one beam when viewed in the vertical direction, hence the compensating member can be prevented from becoming an obstacle when performing maintenance work on the lower portion of the car, with the result that maintenance work can be made easier to perform.

DESCRIPTION OF EMBODIMENTS

Preferred embodiments of the present invention will be described hereinafter with reference to the drawings.

Example 1

Figure 1:
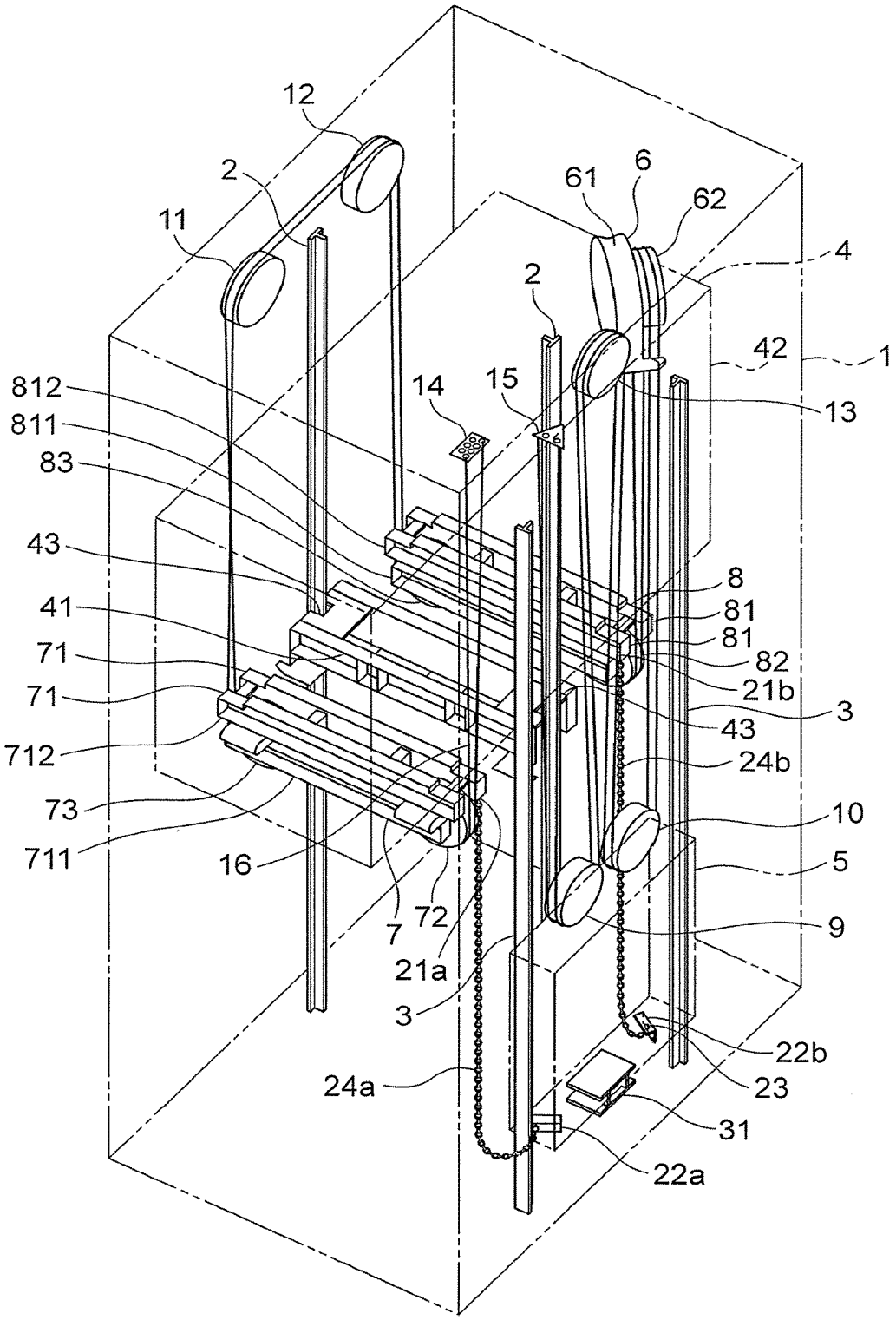
FIG. 1 is a perspective view showing an elevator according to a first embodiment of the present invention.
Figure 2:
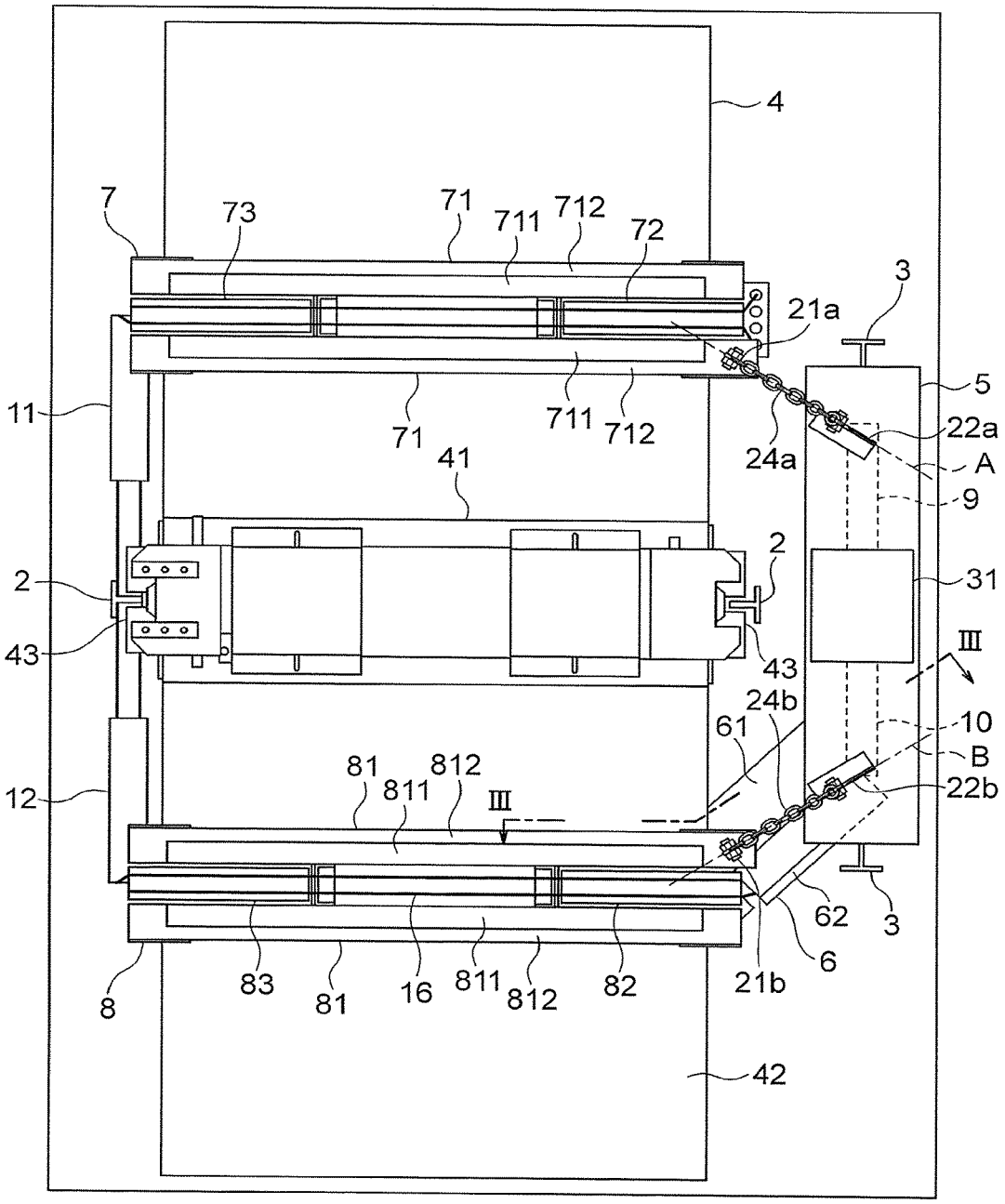
FIG. 2 is a bottom view showing the state of a car and a counterweight shown in FIG. 1 when viewed from below.

FIG. 1 is a perspective view showing an elevator according to a first embodiment of the present invention. Further, FIG. 2 is a bottom view showing the state of a car and a counterweight shown in FIG. 1 when viewed from below. In the drawings, a pair of car guide rails 2, and a pair of counterweight guide rails 3 are respectively disposed vertically in a hoistway 1. Respective lower end portions of the pair of car guide rails 2 and the pair of counterweight guide rails 3 are fixed to a bottom surface of the hoistway 1. In this example, a straight line that connects the pair of car guide rails 2 is perpendicular to a straight line that connects the pair of counterweight guide rails 3 when the hoistway 1 is viewed in a vertical direction.

A car 4 is disposed between the pair of car guide rails 2, and a counterweight 5 is disposed between the pair of counterweight guide rails 3. The car 4 is movable in an up/down direction while being guided by the pair of car guide rails 2. The counterweight 5 is movable in the up/down direction while being guided by the pair of counterweight guide rails 3.

The car 4 has a car frame which includes a lower frame 41, and a car main body 42 to which the lower frame 41 is fixed. The lower frame 41 is fixed horizontally to a lower portion of the car main body 42. Further, the lower frame 41 is arranged on a straight line that connects the pair of car guide rails 2 when the car 4 is viewed in the vertical direction.

A pair of emergency stop devices 43 are provided on the lower frame 41. Among the pair of emergency stop devices 43, one of the emergency stop devices 43 faces one of the car guide rails 2, and the other emergency stop device 43 faces the other car guide rail 2. When the speed of the car 4 becomes excessive, each of the emergency stop devices 43 grip each of the car guide rails 2 individually, whereby a braking force is applied to the car 4 and the car 4 is stopped.

A hoisting machine 6, that is, a driving device for generating a driving force that moves the car 4 and the counterweight 5, is provided in an upper portion of the hoistway 1. The hoisting machine 6 is supported by a machine base (not shown) disposed in the upper portion of the hoistway 1. The machine base is fixed to at least one of the respective upper end portions of the pair of car guide rails 2 and the pair of counterweight guide rails 3. In this way, the elevator in this example is a machine room-less elevator that does not have a machine room.

The hoisting machine 6 includes a hoisting machine main body 61 which includes a motor, and a drive sheave 62 which is provided on the hoisting machine main body 61. The drive sheave 62 is rotated by the driving force of the hoisting machine main body 61. In this example, a radial dimension of the hoisting machine 6 is larger than an axial dimension thereof. Further, in this example, the hoisting machine 6 is arranged such that an axis of the drive sheave 62 is horizontal.

A first car suspending pulley device 7 and a second car suspending pulley device 8 are provided on a lower portion of the car 4 and so as to avoid the lower frame 41. The first and second car suspending pulley devices 7 and 8 are arranged horizontally and such that the car main body 42 is received thereby from below. Further, the first and second car suspending pulley devices 7 and 8 are disposed at opposite sides with respect to a straight line that connects the pair of car guide rails 2 when the car 4 is viewed in the vertical direction. In other words, when the car 4 is viewed in the vertical direction, a straight line that connects the pair of car guide rails 2 passes between the first car suspending pulley device 7 and the second car suspending pulley device 8. In this example, as shown in FIG. 2, when the car 4 is viewed in the vertical direction, the first and second car suspending pulley devices 7 and 8 are arranged in symmetrical positions with respect to the straight line that connects the pair of car guide rails 2.

The first car suspending pulley device 7 includes a pair of first beams 71 which are fixed horizontally to a lower surface of the car main body 42, and two first car suspending pulleys 72 and 73 which are supported by the pair of first beams 71. The pair of first beams 71 are arranged so as to be parallel to each other. Each of the first car suspending pulleys 72 and 73 are arranged so as to be removed from each other in a longitudinal direction of the first beams 71. Further, each of the first car suspending pulleys 72 and 73 are arranged between the pair of first beams 71.

The second car suspending pulley device 8 includes a pair of second beams 81 which are fixed horizontally to the lower surface of the car main body 42, and two second car suspending pulleys 82 and 83 which are supported by the pair of second beams 81. The pair of second beams 81 are arranged so as to be parallel to each other. Each of the second car suspending pulleys 82 and 83 are arranged so as to be removed from each other in a longitudinal direction of the second beams 81. Further, each of the second car suspending pulleys 82 and 83 are arranged between the pair of second beams 81.

In this example, as shown in FIG. 2, when the car 4 is viewed in the vertical direction, each of the first beams 71 and each of the second beams 81 are arranged so as to be parallel to a straight line that connects the pair of car guide rails 2. Further, in this example, the respective axes of the first car suspending pulleys 72 and 73 and the second car suspending pulleys 82 and 83 are perpendicular to the straight line that connects the pair of car guide rails 2.

Each of the first beams 71 includes lower beam members 711, and upper beam members 712 which are fixed to the lower surface of the car main body 42 above the lower beam members 711. The lower beam members 711 and the upper beam members 712 are arranged along the longitudinal direction of the first beams 71. Further, the lower beam members 711 and the upper beam members 712 are connected to each other. Each of the first car suspending pulleys 72 and 73 are attached to each of the lower beam members 711. In this example, a length of the upper beam members 712 is greater than a length of the lower beam members 711. As a result, when viewed in the vertical direction, the longitudinal end portions of the upper beam members 712 protrude from the longitudinal direction end portions of the lower beam members 711 towards outer sides in the longitudinal direction of the first beams 71, as shown in FIG. 2.

Each of the second beams 81 includes lower beam members 811 and upper beam members 812 which are fixed to the lower surface of the car main body 42 above the lower beam members 811. The lower beam members 811 and the upper beam members 812 are arranged along the longitudinal direction of the second beams 81. Further, the lower beam members 811 and the upper beam members 812 are connected to each other. Each of the second car suspending pulleys 82 and 83 are attached to each of the lower beam members 811. In this example, a length of the upper beam members 812 is greater than a length of the lower beam members 811. As a result, when viewed in the vertical direction, the longitudinal end portions of the upper beam members 812 protrude from the longitudinal direction end portions of the lower beam members 811 towards outer sides in the longitudinal direction of the second beams 81, as shown in FIG. 2.

A first weight suspending pulley 9 and a second weight suspending pulley 10 are provided on an upper portion of a counterweight 5. In this example, when the counterweight 5 is viewed in the vertical direction, the first and second weight suspending pulleys 9 and 10 are disposed so as to be removed from each other in a direction following a straight line that connects the pair of counterweight guide rails 3. Further, in this example, when the counterweight 5 is viewed in the vertical direction, the respective axes of the first and second weight suspending pulleys 9 and 10 are perpendicular to a straight line that connects the pair of counterweight guide rails 3.

A shock absorber receiving member 31 is provided in the center on a lower portion of the counterweight 5. When the counterweight 5 descends and arrives at the location of a weight side shock absorber (not shown) provided in the hoistway 1 on a bottom portion thereof, the counterweight 5 collides with the weight side shock absorber via the shock absorber receiving member 31. As a result, impact to which the counterweight 5 is subjected is alleviated.

Two car side return pulleys 11 and 12, one counterweight return pulley 13, a first rope fixing device 14 and a second rope fixing device 15 are also provided in the upper portion of the hoistway 1. In this example, when the hoistway 1 is viewed in the vertical direction, respective axes of each of the car side return pulleys 11 and 12 and the counterweight side return pulley 13 are parallel to a straight line that connects the pair of car guide rails 2. Further, in this example, each of the car side return pulleys 11 and 12, the counterweight side return pulley 13, the first rope fixing device 14, and the second rope fixing device 15 are, in the same way as the hoisting machine 6, supported by the machine base (not shown) disposed in the hoistway 1 at the upper portion thereof.

The car 4 and the counterweight 5 are suspended in the hoistway 1 from a plurality of main ropes 16. A rope, a belt, or the like, for example, is used as the main rope 16. One end portion of the main rope 16 is connected to the first rope fixing device 14 and the other end portion of the main rope 16 is connected to the second rope fixing device 15. The main rope 16 extends from the first rope fixing device 14 and is wrapped around each of the first car suspending pulleys 72 and 73, each of the car side return pulleys 11 and 12, each of the second car suspending pulleys 83 and 82, the drive sheave 62, the second weight suspending pulley 10, the counterweight side return pulley 13, and the first weight suspending pulley 9 in this order, so as to arrive at the second rope fixing device 15. Hence, in this example, a system of hanging the car 4 and the counterweight 5 from the main rope 16 is a 4:1 roping system.

A pair of compensating chains 24*a* and 24*b*, that is, funicular bodies, are suspended between the car 4 and the counterweight 5 as compensating members that compensate for a discrepancy in balance between a car 4 side and a counterweight 5 side. Each of the compensating chains 24*a* and 24*b* are formed by connecting, in series, a plurality of rings. Accordingly, each of the compensating chains 24*a* and 24*b* bend freely due to the relative displacement of the plurality of rings. In each of the compensating chains 24*a* and 24*b*, the plurality of rings are connected in series while the orientation of the rings in the circumferential direction of the compensating chains 24*a* and 24*b* alternates orthogonally.

Among the pair of compensating chains 24*a* and 24*b* suspended between the car 4 and the counterweight 5, the first compensating chain 24*a* is suspended between the first beams 71 and the counterweight 5, and the second compensating chain 24*b* is suspended between the second beams 81 and the counterweight 5.

As a result, an upward load due to the car 4 being suspended from the main rope 16 and a downward load due to the first compensating chain 24*a* being suspended from the first beams 71 are applied to the first beams 71. Also, an upward load due the car 4 being suspended from the main rope 16 and a downward load due to the second compensating chain 24*b* being suspended from the second beams 81 are applied to the second beams 81.

Each of the pair of compensating chains 24*a* and 24*b* has a first end portion, that is, a car side end portion, and a second end portion, that is, a counterweight side end portion. The first end portion of the first compensating chain 24*a* is connected to only one of the first beams 71 of the pair of first beams 71. In this example, the first end portion of the first compensating chain 24*a* is connected to the first beam 71 of the pair of first beams 71 that is on a side close to the counterweight 5. Further, in this example, the first end portion of the first compensating chain 24*a* is connected to the end portion of the upper beam member 712 of the first beam 71 on the counterweight 5 side. Moreover, the first end portion of the first compensating chain 24*a* is located in the region of one of the first beams 71 when viewed in the vertical direction, as shown in FIG. 2. The second end portion of the first compensating chain 24*a* is connected to the lower portion of the counterweight 5. Further, the second end portion of the first compensating chain 24*a* is located in the region of the counterweight 5 when viewed in the vertical direction.

The first end portion of the second compensating chain 24*b* is connected to only one of the second beams 81 of the pair of second beams 81. In this example, the first end portion of the second compensating chain 24*b* is connected to the second beam 81 of the pair of second beams 81 that is on a side close to the counterweight 5. Further, in this example, the first end portion of the second compensating chain 24*b* is connected to the end portion of the upper beam member 812 of the second beam 81 on the counterweight 5 side. Moreover, the first end portion of the second compensating chain 24*b* is located in the region of one of the second beams 81 when viewed in the vertical direction, as shown in FIG. 2. The second end portion of the second compensating chain 24*b* is connected to the lower portion of the counterweight 5. Further, the second end portion of the second compensating chain 24*b* is located in the region of the counterweight 5 when viewed in the vertical direction. In a state where each of the compensating chains 24*a* and 24*b* are suspended respectively between the car 4 and the counterweight 5, curved portions are formed at respective lower end portions of each of the compensating chains 24*a* and 24*b*.

Figure 3:
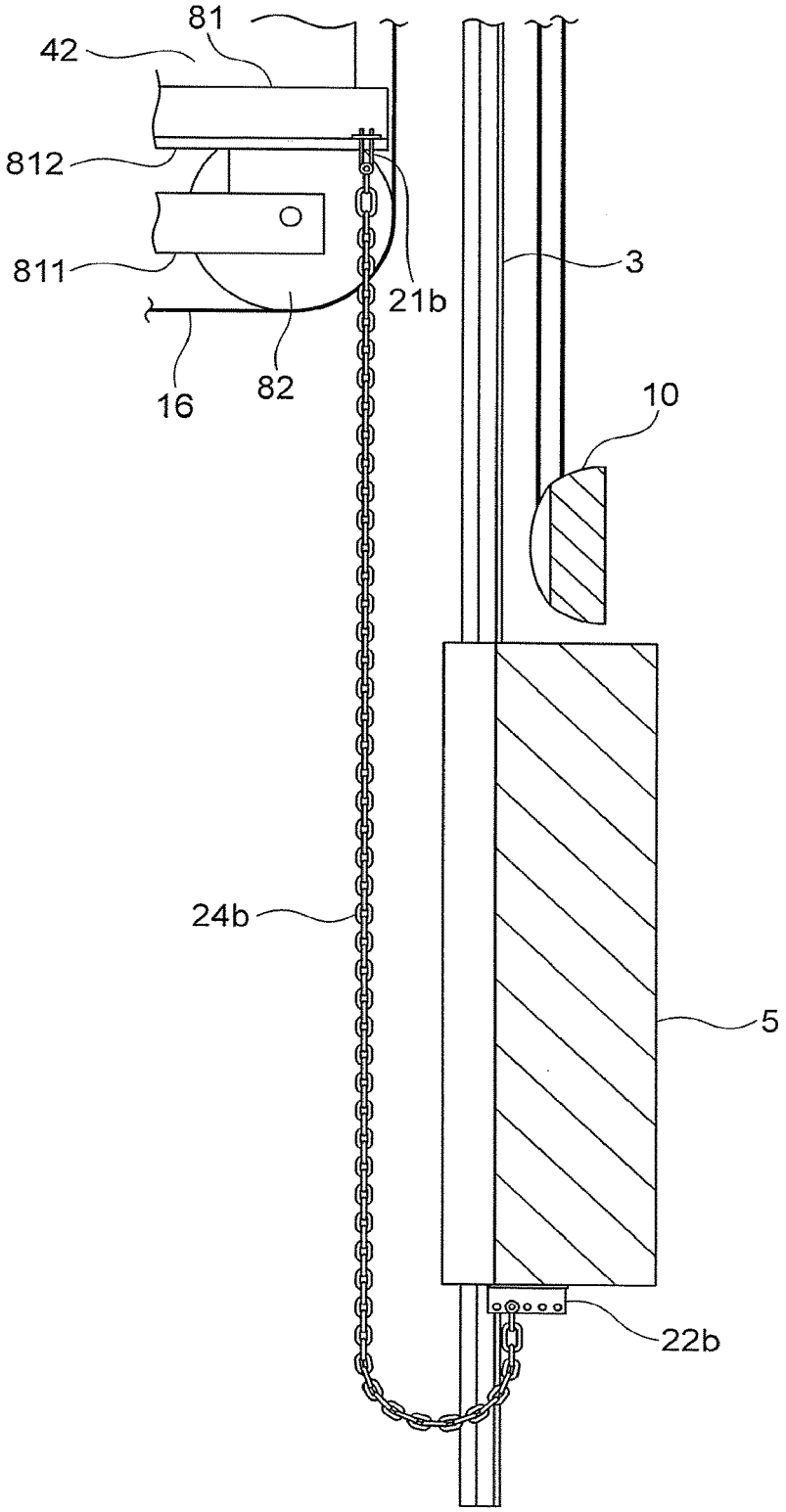
FIG. 3 is a cross-sectional view taken along the III-III line shown in FIG. 2.

FIG. 3 is a cross-sectional view taken along the III-III line shown in FIG. 2. A U-shaped bolt 21*a*, that is, a first connecting tool, is directly fixed to the first beam 71, and a U-shaped bolt 21*b*, that is, a first connecting tool, is directly fixed to the second beam 81. A first U-shaped bolt 21*a* is fixed to the end portion of the upper beam member 712 of one of the first beams 71 on the counterweight 5 side. Further, the first U-shaped bolt 21*a* is located in the region of one of the first beams 71 when viewed in the vertical direction, as shown in FIG. 2. A second U-shaped bolt 21*b* is fixed to the end portion of the upper beam member 812 of one of the second beams 81 on the counterweight 5 side. Further, the second U-shaped bolt 21*b* is located in the region of one of the second beams 81 when viewed in the vertical direction, as shown in FIG. 2.

A pair of angle members 22*a* and 22*b*, that is, second connecting tools, are fixed to the lower surface of the counterweight 5. Each of the angle members 22*a* and 22*b* has an L-shaped cross section. The pair of angle members 22*a* and 22*b* are disposed so as to be removed from each other in the width direction of the counterweight 5. Hence, a first angle member 22*a* is disposed at a position closer to the first beams 71 than the shock absorber receiving member 31 disposed at the center of the counterweight 5, and a second angle member 22*b* is disposed at a position closer to the second beams 81 than the shock absorber receiving member 31 when the car 4 and the counterweight 5 are viewed in the vertical direction. Further, through holes for chain connection are formed in each of the pair of angle members 22*a* and 22*b*.

The first end portion of the first compensating chain 24*a* is attached to the first U-shaped bolt 21*a* fixed to the first beam 71, and the second end portion of the first compensating chain 24*a* is attached, using a through hole, to the first angle member 22*a* fixed to the counterweight 5. In other words, the first compensating chain 24*a* is connected to one of the first beams 71 via the first U-shaped bolt 21*a* and is connected to the counterweight 5 via the first angle member 22*a*.

The first end portion of the second compensating chain 24*b* is attached to the second U-shaped bolt 21*b* fixed to the second beam 81, and the second end portion of the second compensating chain 24*b* is attached, using a through hole, to the second angle member 22*b* fixed to the counterweight 5. In other words, the second compensating chain 24*b* is connected to one of the second beams 81 via the second U-shaped bolt 21*b* and is connected to the counterweight 5 via the second angle member 22*b*.

Here, as each of the U-shaped bolts 21*a* and 21*b* are fixed to the first and second beams 71 and 81, the position of each of the U-shaped bolts 21*a* and 21*b* when the car 4 is viewed in the vertical direction is determined by the position of the first and second car suspending pulley devices 7 and 8. Further, the positions of the first and second car suspending pulley devices 7 and 8 when the car 4 is viewed in the vertical direction are determined by the position, size, and so on of each of the car side return pulleys 11 and 12, the drive sheave 62, and the counterweight 5.

However, the positions of each of the angle members 22*a* and 22*b* when the counterweight 5 is viewed in the vertical direction are positions in which a guide shoe (not shown) and the shock absorber receiving member 31 of the counterweight 5 are avoided. Thus, in some cases, it is not possible to arrange the pair of the compensating chains 24*a* and 24*b* so as to be parallel in the width direction of the hoistway 1.

Accordingly, in the present embodiment, when the hoistway 1 is viewed in the vertical direction, a straight line A, which overlaps the first compensating chain 24*a*, and a straight line B, which overlaps the second compensating chain 24*b*, are straight lines that are not parallel, but which intersect each other, as shown in FIG. 2. That is, when the hoistway 1 is viewed in the vertical direction, a straight line A which connects the first and second end portions of the first compensating chain 24*a* and a straight line B which connects the first and second end portions of the second compensating chain 24*b* are not parallel to each other. Hence, in the present embodiment, when the hoistway 1 is viewed in the vertical direction, the straight line A, which overlaps the first compensating chain 24*a*, is inclined with respect to a straight line that follows the longitudinal direction of the pair of first beams 71, and the straight line B, which overlaps the second compensating chain 24*b*, is inclined with respect to a straight line that follows the longitudinal direction of the pair of second beams 81. Further, in this example, when the hoistway 1 is viewed in the vertical direction, a distance between the two straight lines A and B, which overlap the pair of compensating chains 24*a* and 24*b* respectively, continuously widens from the counterweight 5 towards the car 4.

Figure 4:
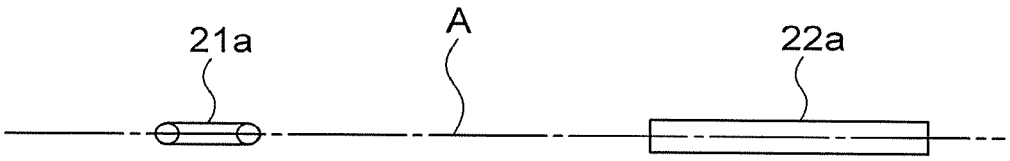
FIG. 4 is a schematic plan view showing the relationship between a straight line that overlaps a first compensating chain, and a first U-shaped bolt and a first angle member shown in FIG. 2.
Figure 5:
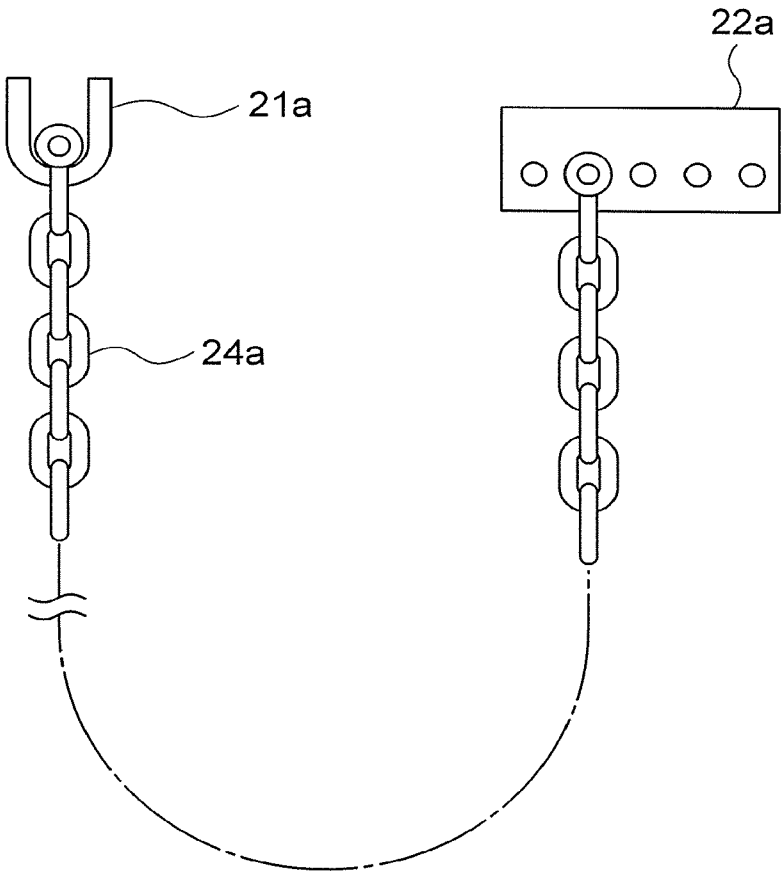
FIG. 5 is a schematic side view showing the connection state of the first compensating chain with respect to the first U-shaped bolt and the first angle member shown in FIG. 4.

Here, FIG. 4 is a schematic plan view showing the relationship between a straight line A, which overlaps the first compensating chain 24*a*, and the first U-shaped bolt 21*a* and the first angle member 22*a* shown in FIG. 2. Further, FIG. 5 is a schematic side view showing the connection state of the first compensating chain 24*a* with respect the first U-shaped bolt 21*a* and the first angle member 22*a* shown in FIG. 4. When the hoistway 1 is viewed in the vertical direction, the first U-shaped bolt 21*a* and the first angle member 22*a* are respectively disposed on the straight line A, which overlaps the first compensating chain 24*a*, and are disposed in a state of following the straight line A, which overlaps the first compensating chain 24*a*, as shown in FIG. 4. Further, when the hoistway 1 is viewed in the vertical direction, the second U-shaped bolt 21*b* and the second angle member 22*b* are disposed on the straight line B, which overlaps the second compensating chain 24*b*, and are disposed in a state of following the straight line B, which overlaps the second compensating chain 24*b*. As a result, when the hoistway 1 is viewed in the vertical direction, the straight line A, which overlaps the first compensating chain 24*a*, and the straight line B, which overlaps the second compensating chain 24*b*, are not parallel to each other, as shown in FIG. 2. Therefore, each of the U-shaped bolts 21*a* and 21*b* are not parallel to each other, and each of the angle members 22*a* and 22*b* are not parallel to each other. As a result, twisting in the circumferential direction of the first and second end portions in each of the compensating chains 24*a* and 24*b* is avoided.

Next, operations will be described. When the hoisting machine 6 is driven and the drive sheave 62 rotates, the main rope 16 moves in accordance with the rotation of the drive sheave 62, and the car 4 and the counterweight 5 move up and down in opposite directions to each other in accordance with the rotation of the drive sheave 62. At this time, each of the compensating chains 24*a* and 24*b* moves in accordance with the movement of the car 4 and the counterweight 5 while the position of the curved portions is maintained. Further, at this time, there is no twisting in the circumferential direction in each of the compensating chains 24*a* and 24*b*, hence, a force by which each of the compensating chains 24*a* and 24*b* sway from side to side is less inclined to be applied thereto even when the car 4 and the counterweight 5 move.

When the car 4 ascends and the counterweight 5 descends, the car 4 moves upward and away from the respective curved portions of each of the compensating chains 24*a* and 24*b*, and the counterweight 5 moves closer thereto from above. As a result, the respective loads of the compensating chain 24*a* applied to the first beam 71 and the compensating chain 24*b* applied the second beam 81 increase, and the respective loads of each of the compensating chains 24*a* and 24*b* applied to the counterweight 5 reduce.

In contrast, when the car 4 descends and the counterweight 5 ascends, the counterweight 5 moves upward and away from the respective curved portions of each of the compensating chains 24*a* and 24*b*, and the car 4 moves closer thereto from above. As a result, the respective loads of the compensating chain 24*a* applied to the first beam 71 and the compensating chain 24*b* applied the second beam 81 reduce, and the respective loads of each of the compensating chains 24*a* and 24*b* applied to the counterweight 5 increase.

In this way, a discrepancy in balance between the car 4 side and the counterweight 5 side, which occurs due to the movement of the main rope 16, is compensated for by the change in loads of the respective compensating chains 24*a* and 24*b* between the car 4 side and the counterweight 5 side.

In such an elevator, the first end portion of the first compensating chain 24*a* is connected to only one of the first beams 71, and the first end portion of the second compensating chain 24*b* is connected to only one of the second beams 81, hence it is possible to eliminate a part that is fixed so as to span the pair of first beams 71 and a part that is fixed so as to span the pair of second beams 81, whereby a number of parts can be reduced and the configuration simplified. Further, as the first compensating chain 24*a* is suspended between the first beams 71 and the counterweight 5, the downward load of the first compensating chain 24*a* can be applied to the first beams 71, to which the upward load of the main rope 16 from which the car 4 is suspended is applied, in a direction that cancels out the upward load, such that the strength of the first beams 71 does not have to be increased. Moreover, as the second compensating chain 24*b* is suspended between the second beams 81 and the counterweight 5, it can be made such that the strength of the second beams 81 does not have to be increased in the same way as for the first beams 71. As a result, cost can be reduced. Further, when viewed in the vertical direction, the first end portion of the first compensating chain 24*a* is located in the region of one of the first beams 71 and, when viewed in the vertical direction, the first end portion of the second compensating chain 24*b* is located in the region of one of the second beams 81, hence it is not necessary to secure a connection space for each of the compensating chains 24*a* and 24*b* on the lower portion of the car main body 42, and it is possible to enlarge a workspace beneath the car main body 42. As a result, the compensating chain 24*a* can be prevented from becoming an obstacle when performing maintenance work on equipment installed on the lower portion of the car main body 42, and the labor involved in this maintenance work can be reduced. Note that examples of equipment installed on the lower portion of the car main body 42 include, for example, the emergency stop devices 43, the first and second car suspending pulleys 72, 73, 82, 83, and the like.

Further, when viewed in the vertical direction, the straight line A, which overlaps the first compensating chain 24*a*, is inclined with respect to a straight line that follows the longitudinal direction of the pair of first beams 71, and a straight line B, which overlaps the second compensating chain 24*b*, is inclined with respect to a straight line that follows the longitudinal direction of the pair of second beams 81, therefore, even when the positions of the first and second suspending pulley devices 7 and 8 are arranged so as to be further toward an outer side in the horizontal direction than the width-direction end portions of the counterweight 5, beam members for connecting the compensating chains 24*a* and 24*b* are not caused to extend in the horizontal direction from the first and second car suspending pulley devices 7 and 8, and the compensating chains 24*a* and 24*b* can be directly connected to the first and second beams 71 and 81. As a result, it is possible to simplify the configuration and reduce cost, and enlarge the workspace beneath the car main body 42 so as to reduce the labor involved in maintenance work.

Further, when viewed in the vertical direction, the first U-shaped bolt 21*a* and the first angle member 22*a* are arranged so as to respectively follow the straight line A, which overlaps the first compensating chain 24*a*, enabling elimination of twisting in the circumferential direction of the first compensating chain 24*a*. As a result, even when the car 4 or the counterweight 5 moves closer to the curved portion formed at the lower end portion of the compensating chain 24*a*, force in a lateral direction due to twisting is less inclined to occur in the compensating chain 24*a*, such that the first compensating chain 24*a* can be made less inclined to sway from side to side. Further, when viewed in the vertical direction, the second U-shaped bolt 21*b* and the second angle member 22*b* are, likewise, arranged so as to respectively follow the straight line B, which overlaps the second compensating chain 24*b*, such that, similar to as in the first compensating chain 24*a*, force in a lateral direction due to twisting is less inclined to occur in the compensating chain 24*b*, such that the second compensating chain 24*b* can be made less inclined to sway from side to side.

Example 2

In the first embodiment, the first end portion of the first compensating chain 24*a* is connected to the upper beam member 712 of the first beam 71, and the first end portion of the second compensating chain 24*b* is connected to the upper beam member 812 of the second beam 81, however, the first end portion of the first compensating chain 24*a* may also be connected to the lower beam member 711 of the first beam 71, and the first end portion of the second compensating chain 24*b* may also be connected to the lower beam member 811 of the second beam 81.

Figure 6:
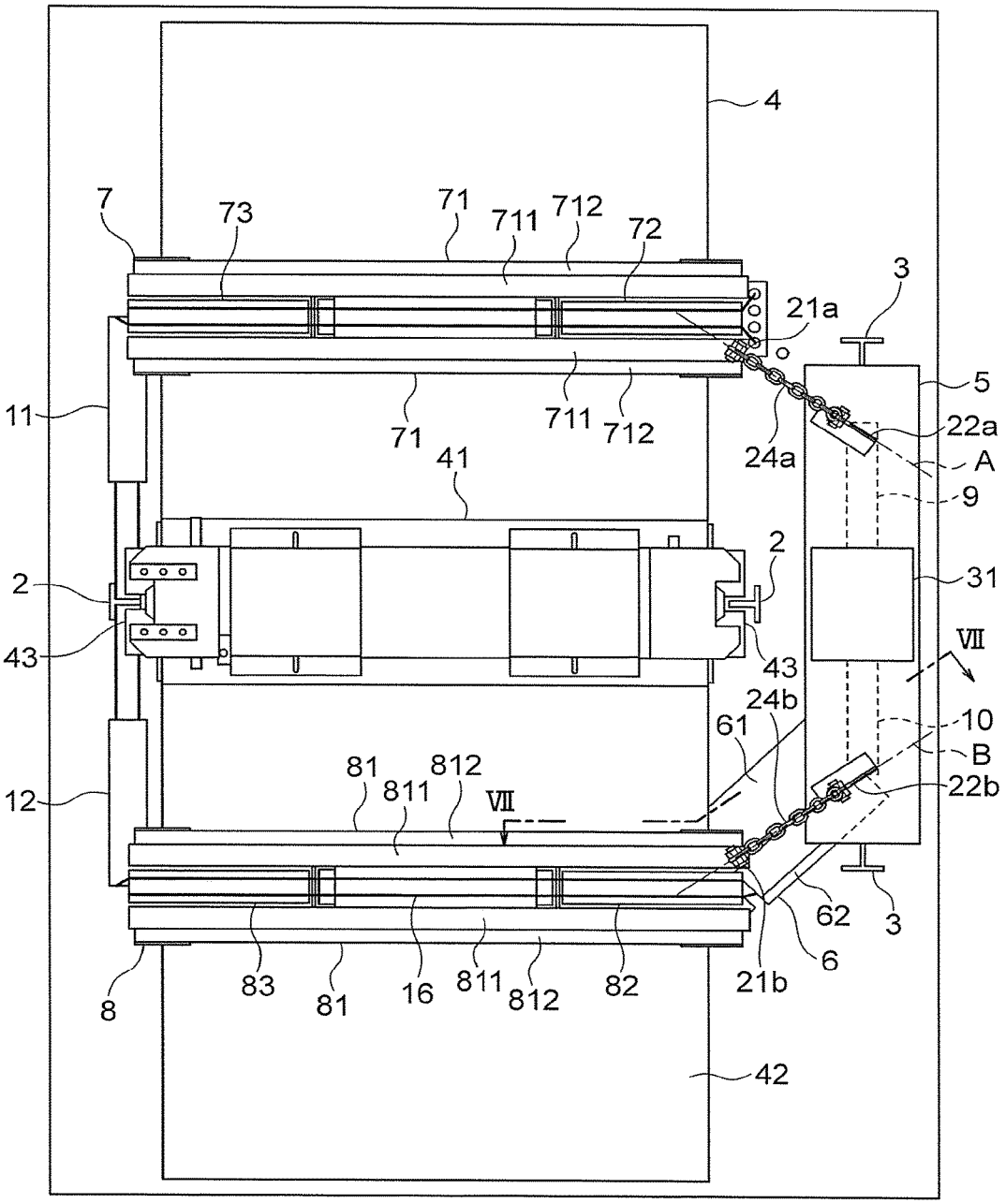
FIG. 6 is a bottom view showing the state of a car and a counterweight in an elevator according to a second embodiment of the present invention when viewed from below.
Figure 7:
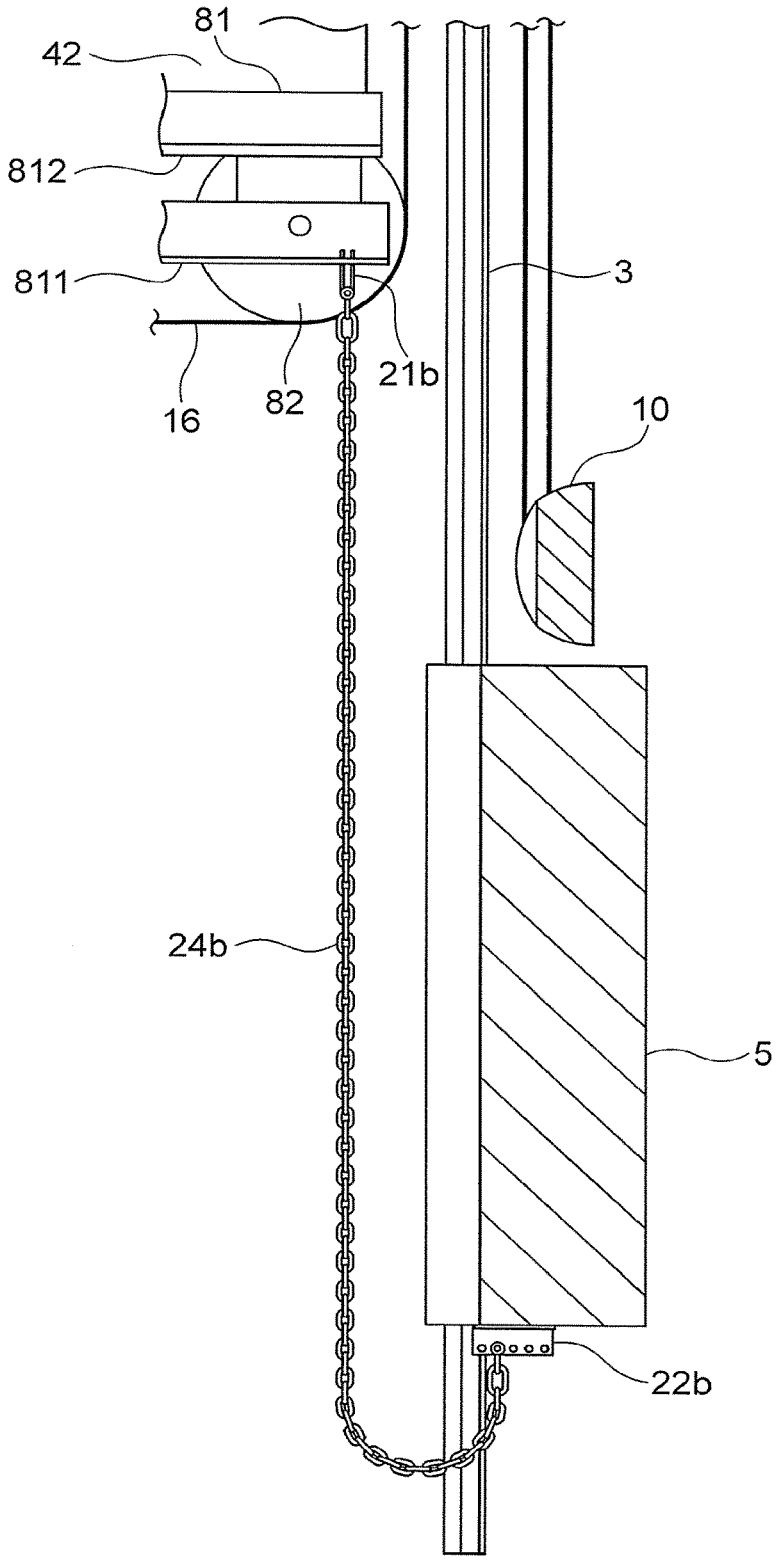
FIG. 7 is a cross-sectional view taken along the VII-VII line shown in FIG. 6.

FIG. 6 is a bottom surface view showing the state of a car and a counterweight in an elevator according to the second embodiment of the present invention when viewed from below. Further, FIG. 7 is a cross-sectional view taken along the VII-VII line shown in FIG. 6. In each of the first beams 71, the length of the lower beam member 711 is greater than the length of the upper beam member 712. Further, in each of the second beams 81, the length of the lower beam member 811 is greater than the length of the upper beam member 812.

The first end portion of the first compensating chain 24*a* is connected to only one of the pair of first beams 71, namely, the first beam 71 that is on a side closer to the counterweight 5. Further, the first end portion of the first compensating chain 24*a* is connected to the end portion of the lower beam member 711 of the first beam 71 on the counterweight 5 side. Moreover, the first end portion of the first compensating chain 24*a* is located in the region of one of the first beams 71 when viewed in the vertical direction.

The first end portion of the second compensating chain 24*b* is connected to only one of the pair of second beams 81, namely, the second beam 81 that is on a side closer to the counterweight 5. Further, the first end portion of the second compensating chain 24*b* is connected to the end portion of the lower beam member 811 of the second beam 81 on the counterweight 5 side. Moreover, the first end portion of the second compensating chain 24*b* is located in the region of one of the second beams 81 when viewed in the vertical direction.

The first U-shaped bolt 21*a* is fixed to the end portion of the lower beam member 711 of one of the first beams 71 on the counterweight 5 side. Further, the first U-shaped bolt 21*a* is located in the region of one of the first beams 71 when viewed in the vertical direction, as shown in FIG. 6. The second U-shaped bolt 21*b* is fixed to the end portion of the lower beam member 811 of one of the second beams 81 on the counterweight 5 side. In addition, the second U-shaped bolt 21*b* is located in the region of one of the second beams 81 when viewed in the vertical direction, as shown in FIG. 6. Other configurations are the same as those of the first embodiment.

With such an elevator, the first end portion of the first compensating chain 24*a* is connected to the lower beam member 711 of one of the first beams 71, and the first end portion of the second compensating chain 24*b* is connected to the lower beam member 811 of one of the second beams 81, hence it is possible to make the first compensating chain 24*a* easier to connect to the first beam 71, and to make the second compensating chain 24*b* easier to connect to the second beam 81.

Note that, in each of the embodiments described above, the first U-shaped bolt 21*a* and the first angle member 22*a* are, when viewed in the vertical direction, respectively arranged so as to follow a straight line A, which overlaps the first compensating chain 24*a*, however, the present invention is not limited to such a configuration, and the first U-shaped bolt 21*a* may also be arranged so as to be perpendicular to the straight line A, which overlaps the first compensating chain 24*a*, and the first angle member 22*a* may also be arranged so as to be perpendicular to the straight line A, which overlaps the first compensating chain 24*a*. Such a configuration also makes it possible to eliminate twisting of the first compensating chain 24*a*, and makes the first compensating chain 24 less inclined to sway from side to side.

Further, in each of the embodiments described above, the second U-shaped bolt 21*b* and the second angle member 22*b* are, likewise, when viewed in the vertical direction, respectively arranged so as to follow the straight line B, which overlaps the second compensating chain 24*b*, however, the present invention is not limited to such a configuration, and the second U-shaped bolt 21*b* may also be arranged so as to be perpendicular to the straight line B, which overlaps the second compensating chain 24*b*, and the second angle member 22*b* may also be arranged so as to be perpendicular to the straight line B, which overlaps the second compensating chain 24*b*. Such a configuration also makes it is possible to eliminate twisting of the second compensating chain 24*b*, and makes the second compensating chain 24*b* less inclined to sway from side to side.

Moreover, in each of the embodiments described above, the first compensating chain 24*a* is suspended between the first beam 71 and the counterweight 5, and the second compensating chain 24*b* is suspended between the second beam 81 and the counterweight 5, however, the compensating chain 24*a* only may be suspended between the first beam 71 and the counterweight 5, or the compensating chain 24*b* only may be suspended between the second beam 81 and the counterweight 5. Such a configuration also makes it unnecessary to increase the strength of the first and second beams 71 and 81, such that cost can be reduced.

Further, in each of the embodiments described above, the hanging method of the car 4 and the counterweight 5 is a 4:1 roping method, however, the hanging method of the car 4 and the counterweight 5 may also be set to a 2:1 roping method. In such a case, the car side return pulleys 11 and 12 and the counterweight side return pulley 13 are eliminated, a car suspending pulley device having the same configuration as the first car suspending pulley device 7 is provided on the lower portion of the car 4, and a weight suspending pulley having the same configuration as the first weight suspending pulley 9 is provided on an upper portion of the counterweight 5. Further, in such a case, the main rope 16 connected to the first and second rope fixing devices 14 and 15 is provided in the hoistway 1 so as to extend from the first rope fixing device 14 and be wrapped around each of the car suspending pulleys of the car suspending pulley device, the drive sheave 62, and the weight suspending pulley in this order, so as to arrive at the second rope fixing device 15. Further, in such a case, a compensating chain, that is, a funicular body, is suspended between a beam of the car suspending pulley device and the counterweight 5 as a compensating member.

In addition, in each of the embodiments described above, the compensating chain 24*a* is used as a compensating member to be suspended between the first beam 71 and the counterweight 5. However, the present invention is not limited to such a configuration, and a compensating rope, that is, for example, a funicular body formed by twisted wires, or a compensating cable, that is, a funicular body in which a compensating chain having a first end portion and a second end portion is coated with a coating material, may also be used as a compensating member to be suspended between the first beam 71 and the counterweight 5. Examples of elastic materials for use in the compensating cable include rubber and the like.

Further, in each of the embodiments described above, the compensating chain 24*b* is used as a compensating member to be suspended between the second beam 81 and the counterweight 5. However, the present invention is not limited to such a configuration, and a compensating rope, that is, for example, a funicular body formed by twisted wires, or a compensating cable, that is, a funicular body in which a compensating chain having a first end portion and a second end portion is coated with a coating material, may also be used as a compensating member to be suspended between the second beam 81 and the counterweight 5. Examples of elastic materials for use in the compensating cable include rubber and the like.

Moreover, in each of the embodiments described above, the first connecting tools fixed to the first and second beams 71 and 81 are the U-shaped bolts 21*a* and 21*b*, however, angle members provided with through holes for connecting compensating members may also be used as the first connecting tools. Further, in the above examples, the second connecting tools fixed to the counterweight 5 are angle members, however, U-shaped bolts may also be used as the second connecting tools.

The invention claimed is:

1. An elevator comprising:

a car;

a counterweight;

a car suspending pulley device including a pair of beams provided parallel to each other on a lower portion of the car and a car suspending pulley arranged between the pair of beams and supported by the pair of beams;

a weight suspending pulley provided on the counterweight;

a main rope wrapped around the car suspending pulley and the weight suspending pulley and suspending the car and the counterweight; and a compensating member including a funicular body having a first end portion connected to only one of the pair of beams and a second end portion connected to the counterweight, and suspended between the one beam and the counterweight, wherein the first end portion is located in a region of the one beam when viewed in a vertical direction.

2. The elevator according to claim 1, wherein when viewed in the vertical direction, a straight line that overlaps the funicular body is inclined with respect to a straight line following a longitudinal direction of the pair of beams.

3. The elevator according to claim 2, wherein the funicular body is a chain;

a first connecting tool is fixed to the one beam;

a second connecting tool is fixed to the counterweight;

the first end portion of the chain is connected to the one beam by being attached to the first connecting tool and the second end portion of the chain is connected to the counterweight by being attached to the second connecting tool;

the first connecting tool is arranged in one of a state of following a straight line that overlaps the chain and a state of being perpendicular to the straight line that overlaps the chain when viewed in the vertical direction; and the second connecting tool is arranged in one of a state of following the straight line that overlaps the chain and a state of being perpendicular to the straight line that overlaps the chain when viewed in the vertical direction.

4. The elevator according to claim 1, wherein the funicular body is a chain;

a first connecting tool is fixed to the one beam;

a second connecting tool is fixed to the counterweight;

the first end portion of the chain is connected to the one beam by being attached to the first connecting tool and the second end portion of the chain is connected to the counterweight by being attached to the second connecting tool;

the first connecting tool is arranged in one of a state of following a straight line that overlaps the chain and a state of being perpendicular to the straight line that overlaps the chain when viewed in the vertical direction; and the second connecting tool is arranged in one of a state of following the straight line that overlaps the chain and a state of being perpendicular to the straight line that overlaps the chain when viewed in the vertical direction.

* * * * *